US006024439A

United States Patent [19]

Sueoka et al.

[11] Patent Number: 6,024,439

[45] **Date of Patent: *Feb. 15, 2000**

[54] INK-JET HEAD HAVING PROJECTING PORTION

[75] Inventors: Manabu Sueoka, Yokohama; Toshiaki Hirosawa, Hiratsuka; Toru Yamane, Yokohama, all of Japan

[73] Assignee: Canon Kabushiki Kaisha, Tokyo, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/715,123

[22] Filed: Sep. 17, 1996

[30] Foreign Application Priority Data

Sep. 21, 1995 [JP] Japan ..... 7-243396

[51] Int. Cl.[7] ..... B41J 2/14

[52] U.S. Cl. ..... 347/50; 347/67

[58] Field of Search ..... 347/58, 57, 56, 347/54, 20, 1, 50, 67

[56] References Cited

U.S. PATENT DOCUMENTS

| | | | |
|---|---|---|---|
| 4,313,124 | 1/1982 | Hara | 347/57 |
| 4,345,262 | 8/1982 | Shirato et al. | 347/10 |
| 4,459,600 | 7/1984 | Sato et al. | 347/47 |
| 4,463,359 | 7/1984 | Ayata et al. | 347/56 |
| 4,558,333 | 12/1985 | Sugitani et al. | 347/65 |
| 4,608,577 | 8/1986 | Hori | 347/66 |
| 4,723,129 | 2/1988 | Endo et al. | 347/56 |
| 4,740,796 | 4/1988 | Endo et al. | 347/56 |
| 5,164,747 | 11/1992 | Osada et al. | 346/140 R |
| 5,243,363 | 9/1993 | Koizumi et al. | 347/50 |
| 5,345,256 | 9/1994 | Stortz | 347/20 |
| 5,398,053 | 3/1995 | Hirosawa | 347/13 |
| 5,420,620 | 5/1995 | Tamura | 347/50 |
| 5,485,185 | 1/1996 | Sueoka et al. | 347/64 |

FOREIGN PATENT DOCUMENTS

| | | |
|---|---|---|
| 0442706 | 8/1991 | European Pat. Off. . |
| 0611653 | 8/1994 | European Pat. Off. . |
| 54-56847 | 5/1979 | Japan . |
| 59-123670 | 7/1984 | Japan . |
| 59-138461 | 8/1984 | Japan . |
| 60-71260 | 4/1985 | Japan . |

*Primary Examiner*—John Barlow
*Assistant Examiner*—Charles W. Stewart, Jr.
*Attorney, Agent, or Firm*—Fitzpatrick, Cella, Cella & Harper

[57] ABSTRACT

The present invention provides an ink-jet head, an ink-jet cartridge and an ink-jet apparatus, which can provide certain and stable electrical connection in a separable manner between an energy generation element unit and a driving element unit. The ink-jet head includes the energy generation element unit $U_E$ having signal wires for supplying electric signals for heat generating resistors, and connecting electrodes projectingly provided at the ends of the signal wires positioned on the mating surface $F_E$, and the driving element unit $U_D$ having signal wires for feeding electric signals from the driving elements for driving head generating resistors, and connecting electrodes projectingly provided at the ends of the signal wires positioned on the mating surface $F_D$. The connecting electrodes are connected to each other by mutually mating the mating surfaces $F_E$ and $F_D$ of the energy generation element unit $U_E$ and the driving element unit $U_D$. Projecting portion is formed on at least one of the mating surfaces $F_E$ for maintaining mating interval between two units $U_E$ and $U_D$.

23 Claims, 11 Drawing Sheets

INK-JET HEAD HAVING PROJECTING PORTION

BACKGROUND OF THE INVENTION

1. Field of the Invention

The present invention relates to an ink-jet head having an energy generation element unit including an energy generation element for ejecting a liquid to perform printing on a printing medium and a driving element unit including a driving element for driving the energy generation element, an ink-jet cartridge loaded the ink-jet head, and an ink-jet apparatus employing the ink-jet head.

2. Description of the Related Art

An ink-jet printing method is a method for performing printing by ejecting an ink and/or a treatment liquid for adjusting characteristics of the ink through ejection openings arranged in an ink-jet head and by depositing the ink and/or the treatment liquid on a printing medium, such as a paper or so forth, and thus is advantageous for quite low noise and capability of high speed printing. Amongst, an ink-jet head of the type, in which a thermal energy is acted on a liquid for abruptly heating the liquid to generate bubble, and whereby for ejecting a liquid droplet of the liquid within a liquid passage through ejection openings by volume expansion by the bubble, and the liquid is introduced into the liquid passage from a liquid chamber upon quenching of the bubble, has advantages in high response characteristics to a printing signal and in ease of making to an ink-jet head having much more ejecting openings.

An external appearance of the energy generation element unit of the ink-jet head is shown in FIG. 11, and a partially cut-out condition thereof is also shown in FIG. 12. Namely, a heat generating resistor 102 serving an electrothermal transducer as the energy generation element is provided on an insulation layer formed on the surface of a substrate 101. Also, a not shown electrode for supplying a power to the heat generating resistor 102 is arranged. A liquid passage 103, to which the heat generating resistor 102 on the substrate, is opened to ejection openings 104 at one end, and is communicated with a common liquid chamber 105 at the other end. In the common liquid chamber 105, a not shown liquid tank separately provided to the ink-jet head is connected via a coupling member 106.

As shown, when the heat generating resistor 102 is assembled for each of the liquid passages 103 respectively communicated with ejection openings arranged in alignment for performing printing of a plurality of dots for the printing medium, simultaneously, it becomes necessary to control ON and OFF of power supply independently for respective heat generating resistors 102. For performing control for the driving element may be integrally assembled to the energy generation element unit 107, as set forth above, or, in the alternative, as shown in FIG. 13 and FIG. 14 which shows a sectional structure along line XIV—XIV, is electrically connected to the energy generation element unit 107 via the bonding wire 108.

However, when the energy generation element unit 107 is fixedly connected with the driving element 109 and the bonding wire 108, if failure is caused in any one of the heat generation resistor 102 and the driving element 109, the overall ink-jet head can become inoperative.

For solution of such problem, employing the driving element unit having the driving element shown in FIG. 15, there has been proposed an ink-jet head and an ink-jet apparatus employing the ink-jet head establishing electrical connection by making the driving element unit 110 and the energy generation element unit 107 separable, and tightly stacking connecting electrodes 111 and 112 to each other as shown in FIG. 16.

As shown in FIG. 16, in the ink-jet head, in which the energy generation element unit 107 and the driving element unit 110 are made separable and tightly stacked, the connecting electrodes 111 and 112 are provided in number corresponding to the heat generating resistor 102 actually ejecting the ink. In order to completely achieve the functions and performance as the ink-jet head, all of these connecting electrodes 111 and 112 are required to be certainly connected.

However, conventionally, it is possible to cause non-uniformity in the height and shape of the connecting electrodes 111 and 112 projecting from mating surfaces 113 and 114 of respective units 107 and 110, and to cause connection failure between the connection electrodes 111 and 112 at the occurrence of offset of acting point of compression force upon connection of the units 107 and 110 as shown in FIG. 17 which causes moment between the units 107 and 110 about the centers of the connection electrodes 111 and 112.

SUMMARY OF THE INVENTION

Therefore, it is an object of the present invention to provide an ink-jet head, an ink-jet cartridge loaded the ink-jet head, and an ink-jet apparatus employing the ink-jet head, which can certainly and stably establish electrical connection in a separable manner between the energy generation element unit and the driving element unit.

According to the first aspect of the invention, there is provided an ink-jet head comprising:

an energy generation element unit having
- a plurality of energy generation elements for ejecting a liquid,
- a plurality of connecting electrodes projectingly formed on a mating surface of the energy generation element unit, and
- a plurality of signal wires connected to the energy generation elements at one ends and to the connecting electrodes at the other ends respectively;

a driving element unit having
- a plurality of driving elements for driving to the energy generation elements,
- a plurality of connecting electrodes projectingly formed on a mating surface of the driving element unit, and
- a plurality of signal wires connecting to the driving elements at one ends and to the connecting electrodes at the other ends respectively;

the connecting electrodes of the energy generation element unit and the driving element unit being connected to each other by mutually mating the mating surfaces of the energy generation element unit and the driving element unit, and wherein projecting portion for maintaining mating interval between the mating surfaces of the energy generation element unit and the driving element unit, being formed on at least one of the energy generation element unit and the driving element unit.

With the first aspect of the ink-jet head according to the present invention, when the connecting electrodes of the energy generation element unit and the driving element unit are connected to each other by mutually mating the mating surfaces of the energy generation element unit and the driving element unit, projecting portion for maintaining mating interval between the mating surfaces of the energy generation element unit and the driving element unit, is formed on at least one of the energy generation element unit and the driving element unit. These mating surfaces are correctly mated to correctly contact all of the connecting electrodes.

Electric signals fed from the driving element of the driving element unit via the signal wires, is supplied to the energy generation elements from the signal wires of the energy generation element units via the connection electrodes. Thus, the energy generation elements are energized for ejecting the liquid.

Here, the projecting portion may have a region arranged in alignment with the connecting electrodes, or a region aligned on an extension of the other end sides of the signal wires along arranging direction of the connecting electrodes. In the alternative, the projecting portion may have a region aligned with the connecting electrodes and a region aligned on an extension of the other end sides of the signal wires along arranging direction of the connecting electrodes. On the other hand, the projecting portion may be a dummy electrode in a shape corresponding to the connecting electrode. The energy generation element may be an electrothermal transducer generating a thermal energy for causing film boiling in the liquid.

According to the second aspect of the present invention, there is provided an ink-jet cartridge comprising:

an ink-jet head including an energy generation element unit having a plurality of energy generation elements for ejecting a liquid, a plurality of connecting electrodes projectingly formed on a mating surface of the energy generation element unit, and a plurality of signal wires connected to the energy generation elements at one ends and to the connecting electrodes at the other ends respectively, a driving element unit having a plurality of driving elements for driving to the energy generation elements, a plurality of connecting electrodes projectingly formed on a mating surface of the driving element unit, and a plurality of signal wires connecting to the driving elements at one ends and to the connecting electrodes at the other ends respectively;

the connecting electrodes of the energy generation element unit and the driving element unit being connected to each other by mutually mating the mating surfaces of the energy generation element unit and the driving element unit, a liquid tank for storing the liquid to be supplied to the ink-jet head; and wherein projecting portion for maintaining mating interval between the mating surfaces of the energy generation element unit and the driving element unit, being formed on at least one of the energy generation element unit and the driving element unit.

Here, the liquid may be desirably an ink or a treatment liquid for adjusting property of the ink to be ejected on a printing medium, or the ink and the treatment liquid.

According to the third aspect of the present invention, there is provided an ink-jet apparatus employing an ink-jet head comprising:

the ink-jet head including an energy generation element unit having a plurality of energy generation elements for ejecting a liquid, a plurality of connecting electrodes projectingly formed on a mating surface of the energy generation element unit, and a plurality of signal wires connected to the energy generation elements at one ends and to the connecting electrodes at the other ends respectively, a driving element unit having a plurality of driving elements for driving to the energy generation elements, a plurality of connecting electrodes projectingly formed on a mating surface of the driving element unit, and a plurality of signal wires connecting to the driving elements at one ends and to the connecting electrodes at the other ends respectively;

the connecting electrodes of the energy generation element unit and the driving element unit being connected to each other by mutually mating the mating surfaces of the energy generation element unit and the driving element unit, and wherein projecting portion for maintaining mating interval between the mating surfaces of the energy generation element unit and the driving element unit, being formed on at least one of the energy generation element unit and the driving element unit.

Here, the projecting portion may have a region arranged in alignment with the connecting electrodes, or a region aligned on an extension of the other end sides of the signal wires along arranging direction of the connecting electrodes. In the alternative, the projecting portion may have a region aligned with the connecting electrodes and a region aligned on an extension of the other end sides of the signal wires along arranging direction of the connecting electrodes. On the other hand, the projecting portion may be a dummy electrode in a shape corresponding to the connecting electrode. Also, the ejection openings may be arranged over the entire width of the printing region of the printing medium.

With the ink-jet head according to the present invention, since the projecting portion for maintaining the mating interval of mating surfaces of the energy generation element unit and the driving element unit. Thus, tight fitting condition of the connecting electrodes of two units can be unified to enable easy, certain and reliable electrical connection.

On the other hand, position of acting point of pressurizing force upon coupling the energy generation element unit and the driving element unit may be rough in comparison with that required in the prior art. Thus, connection can be certainly established with simpler mechanism to achieve lowering of cost.

BRIEF DESCRIPTION OF THE DRAWINGS

The present invention will be understood more fully from the detailed description given herebelow and from the accompanying drawings of the preferred embodiment of the invention, which, however, should not be taken to be limitative to the present invention, but are for explanation and understanding only.

In the drawings:

FIG. 11 is a perspective view showing external appearance of an energy generation element unit of the ink-jet head, to which the present invention is directed to;

DETAILED DESCRIPTION OF THE PREFERRED EMBODIMENT

Several embodiments of an ink-jet head according to the present invention will be discussed hereinafter in detail with reference to FIGS. 1 to 8. It should be noted that the basic construction of a portion of connecting electrode provided for each of the energy generation element unit and the driving element unit constructing the ink-jet head, can be identical in both of two units.

Accordingly, while the following discussion will be concentrated to the energy generation element unit as one of the units, the driving element unit may employ the structure in a portion of the connection electrode identical to that in the energy generation element unit.

Figure 1:
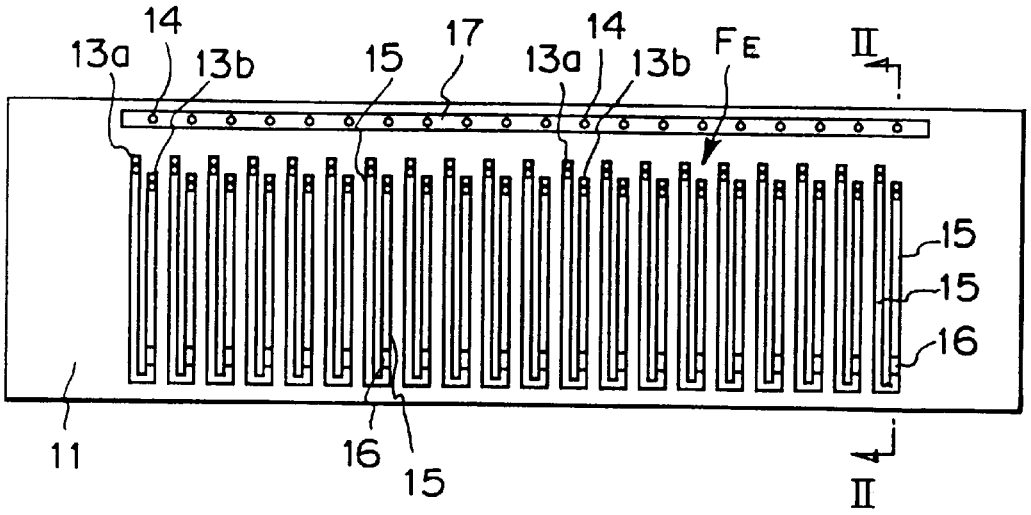
FIG. 1 is a plan view showing a configuration of the first embodiment of a portion of a substrate forming an energy generation element unit of an ink-jet head according to the present invention.
Figure 2:
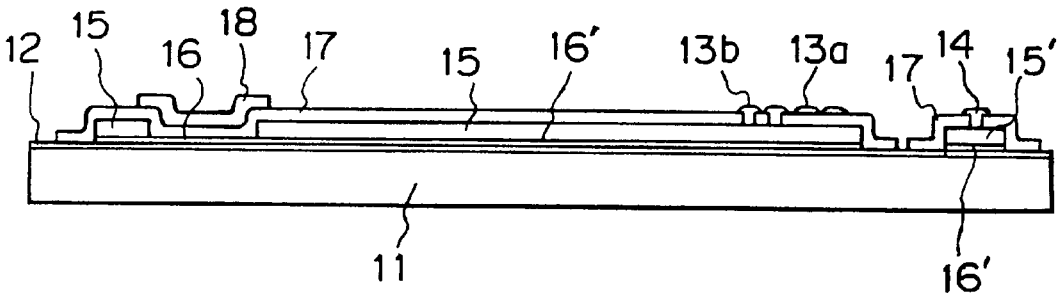
FIG. 2 is a section taken along line II—II of FIG. 1.
Figure 3:
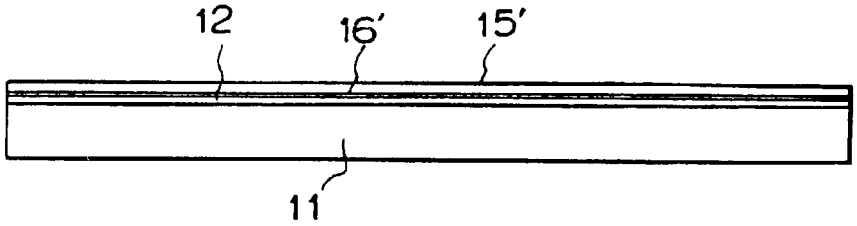
FIG. 3 is a section showing a production process of the substrate shown in FIG. 2, together with FIGS. 4 and 5.

As shown in FIG. 1 showing external appearance of a surface of a substrate of the first embodiment of an energy generation element unit and in FIG. 2 showing a sectional structure along line II—II of FIG. 1, on the surface of a quadrangular substrate 11, an insulative layer 12 having a head accumulation ability, such as silicon dioxide ($SiO_2$) is formed. On the insulative layer 12, a plurality of pairs of connection electrodes 13*a*, 13*b* and a dummy electrode 14 are arranged in alignment with given intervals along longitudinal direction. A portion of the surface of the substrate 11 around the connection electrodes 13*a*, 13*b* and the dummy electrode 14 serves as mating surface $F_E$ of the present invention.

Respective pairs of the connection electrodes 13*a* and 13*b* are formed at one end portion of signal lines 15, such as aluminum or so forth, extending in back and forth direction (left and right direction in FIG. 2) of the substrate 11. The other ends of respective pairs of the signal lines 15 are mutually connected via heat generation elements, such as hafnium diboride ($HfB_2$) or so forth, which serves as the energy generation elements to form U-shaped configurations as a whole. These connection electrodes 13*a* and 13*b* are stacked on a resistor layers 16' and the signal lines 15. Except for these connection electrodes 13*a* and 13*b*, the resistor layers 16 ' and the signal lines 15 are covered with an oxidation resistive insulation layer 17 of silicon dioxide or so forth. Furthermore, an anti-cavitation layer 18 of tantalum or so forth is stacked on the heat generation resistor 16 via the insulation layer 17.

The dummy electrode 14 as projecting portions of the present invention are arranged along the direction of alignment of the connection electrodes 13*a* and 13*b* in parallel relationship thereto at the position inclined to one end in the back and forth direction of the substrate 11 than the connection electrodes 13*a* and 13*b*. Similarly to the connection electrodes 13*a* and 13*b*, the dummy electrodes 14 are stacked on the resistor layer 16' and a conductive layer 15'. These resistor layer 16' and the conductive layer 15' are covered with the insulation layer 17 except for the dummy electrodes 14.

Now, discussion will be given for fabrication process of the substrate 11 having the construction as set forth above. At first, on the surface of the substrate 11, the insulative layer 12, the resistor layer 16' and the conductive layer 15' are deposited in stacking manner respective at thicknesses of 2 m, 0.2 m and 0.6 m (see FIG. 3).

Figure 4:
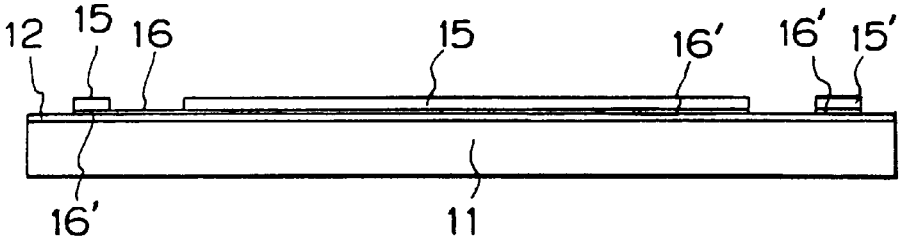
FIG. 4 is a section showing a production process of the substrate shown in FIG. 2, together with FIGS. 3 and 5.
Figure 5:
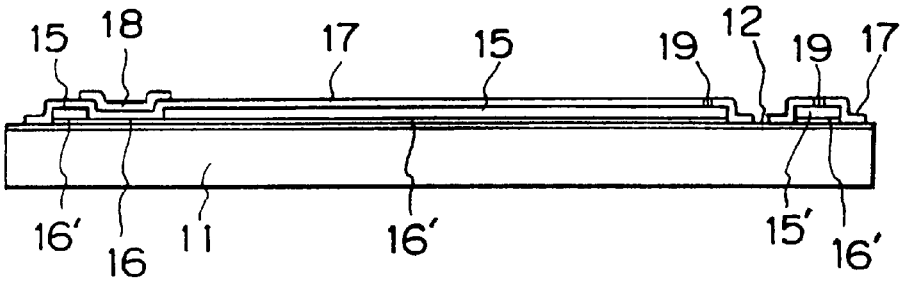
FIG. 5 is a section showing a production process of the substrate shown in FIG. 2, together with FIGS. 3 and 4.

Then, by employing a photolithographic technology, respective of the resistor layer 16' and the conductive layer 151 are etched by way of photolithographic technology to pattern the head respective to the heat generation resistor 16 and the signal lines 15, and the resistor layer 16' and the conductive layer 15' (see FIG. 4).

Thereafter, on the surfaces of these layers, insulation layer and the anti-cavitation layer respectively having thicknesses of 0.9 m and 0.5 m are formed by way of sputtering. Then, by way of photolithographic technology, the insulation layer 17 and the anti-cavitation layer 18 are patterned. At this time, on the surface of the signal lines 15 and the surfaces corresponding to the dummy electrodes 14 and mating with the surface of the conductive layer 15', a part of the insulation layer 17 is etched to form through holes 19 (see FIG. 5).

As an undercoating layer of electroplating, titanium and copper are respectively deposited in order at thicknesses of 0.05 m and 0.3 m. Then, after forming a pattern employing a resist for forming plated layer, several micrometers to several tens micrometers of layers of gold, nickel, copper, white gold or so forth is deposited. Thereafter, the resist is peeled off and etching for the under-coating layer is performed to form the connection electrodes 13*a* and 13*b* and the dummy electrodes 14 in the portion of the through holes 19 in a manner shown in FIG. 2.

Figure 11:
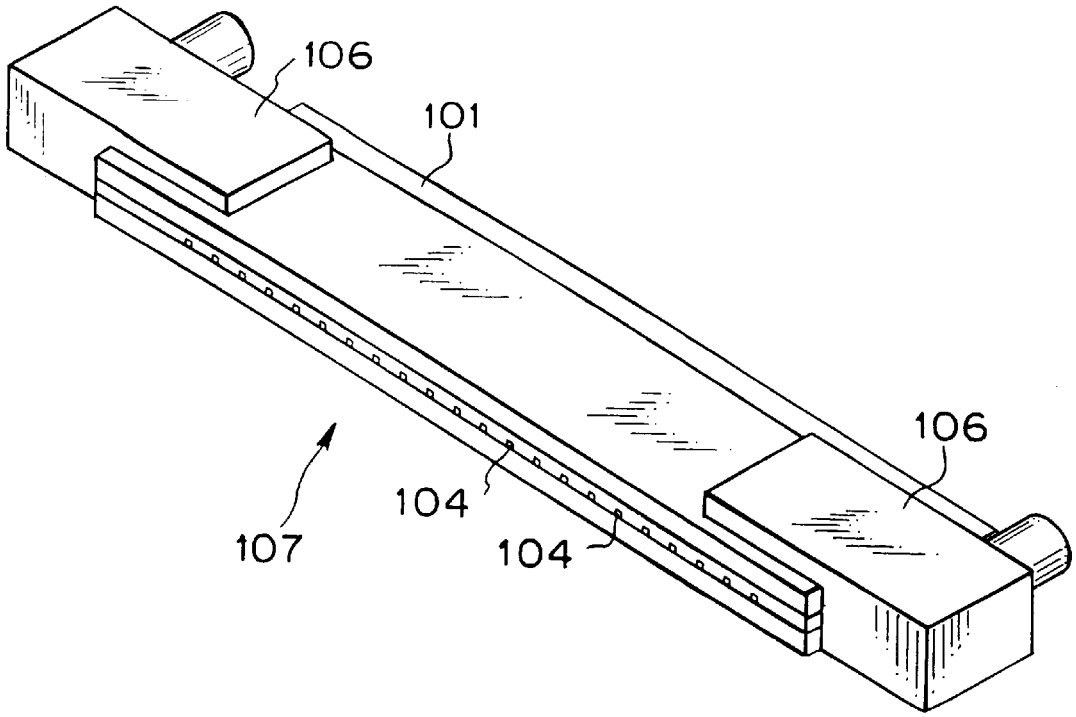
Figure 12:
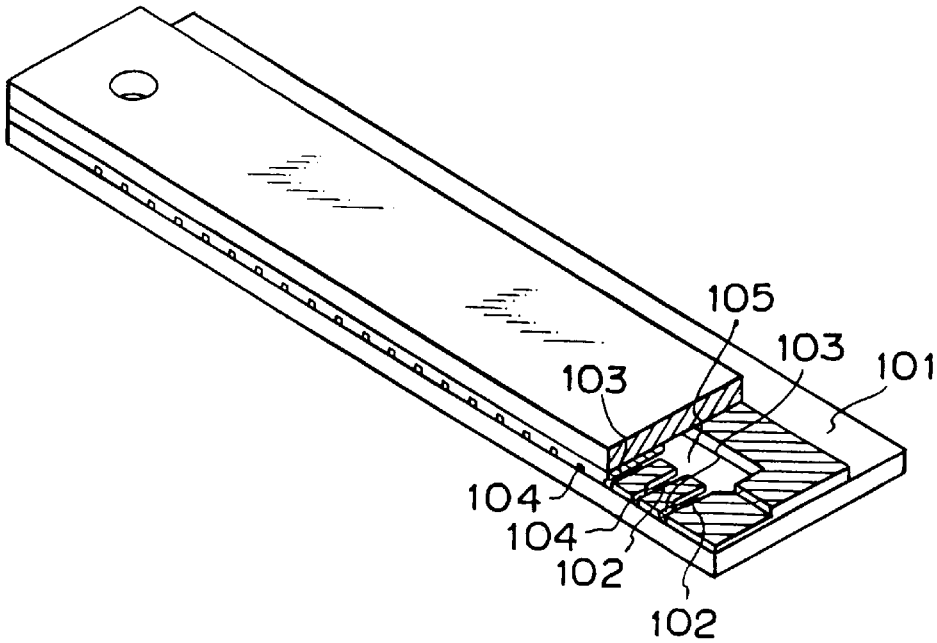
FIG. 12 is a perspective view showing a partly cut-out energy generation element unit shown in FIG. 11.
Figure 13:
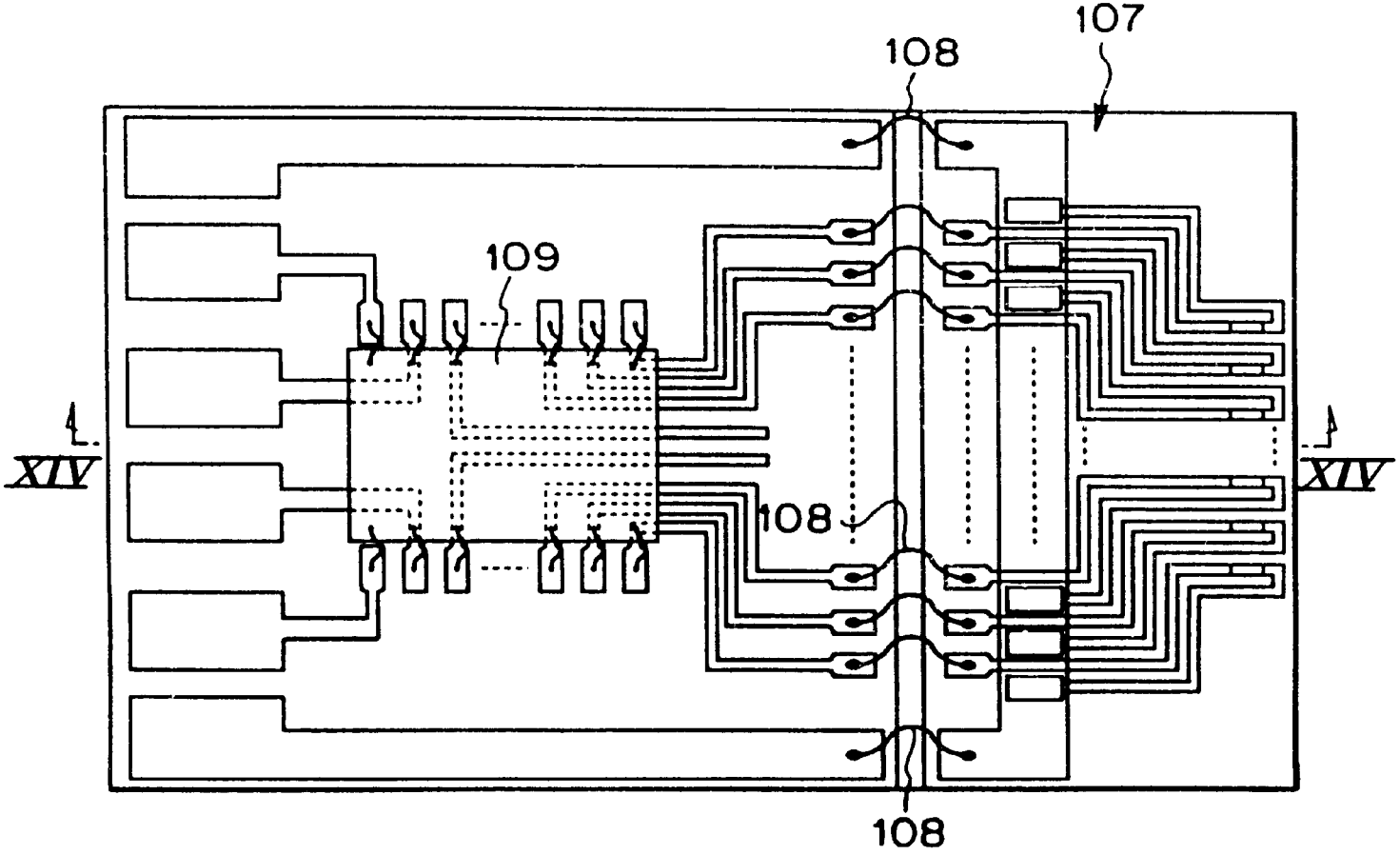
FIG. 13 PRIOR ART
FIG. 13 is a plan view showing an electrical circuit of the conventional ink-jet head.
Figure 14:
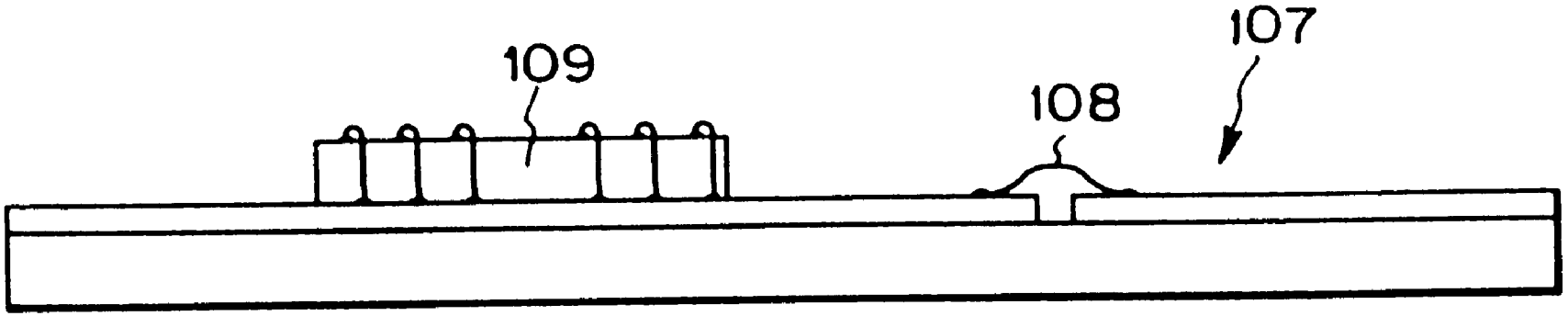
FIG. 14 PRIOR ART
FIG. 14 is a section taken along line XIV—XIV of FIG. 13.
Figure 15:
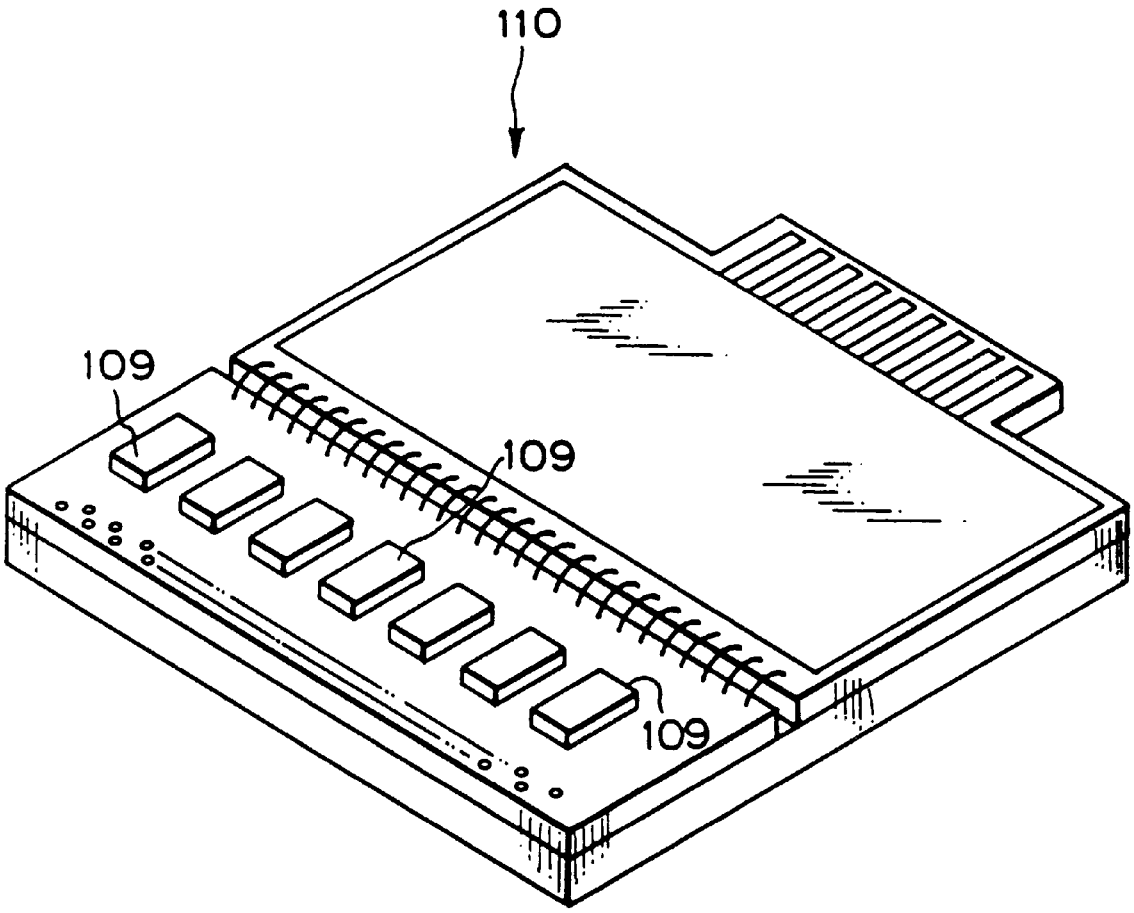
FIG. 15 PRIOR ART
FIG. 15 is a perspective view showing an external appearance of the conventional driving element unit.

With respect to the substrate 11 thus obtained, ejection openings 104, ink passages 103 and common ink chamber 105 and so forth, shown in FIG. 12 are formed. Also, a coupling member 106 is further coupled to form the energy generation element unit, as shown in FIG. 11.

Figure 6:
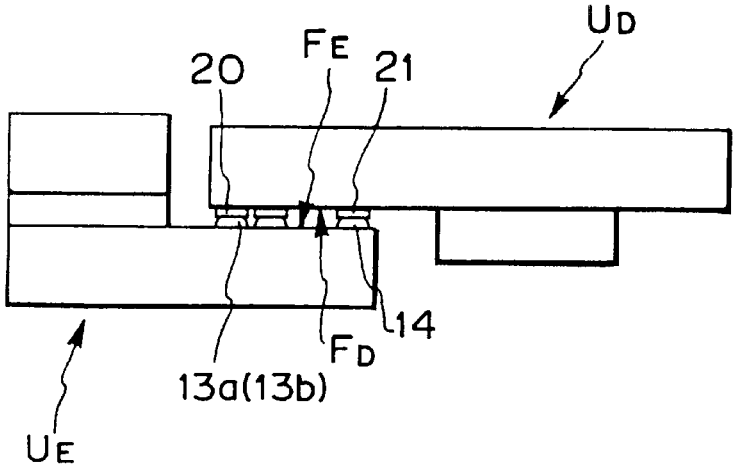
FIG. 6 is a conceptual illustration showing a coupled condition of the energy generating element unit and the driving element unit according to the present invention.

As shown in FIG. 6, in which is shown the external appearance of the ink-jet head, in which the energy generation element unit and the driving element unit are assembled, the mating surface $F_E$ of the energy generation element unit $U_E$ projecting the connecting electrodes 13*a* and 13*b* and the dummy electrodes 14 is mated with a mating surface $F_D$ Of the driving element unit $U_D$ projecting connection electrodes 20 and dummy electrodes 21. When the connecting electrodes 13*a*, 13*b* and 20 are mutually connected, if acting point of connecting force is present between the connection electrodes 13*a*, 13*b* and 20 and the dummy electrodes 14 and 21, the mating surfaces $F_E$ and $F_D$ are maintained in parallel relationship to each other, and thus, the connecting electrodes 13*a*, 13*b* and 20 can be maintained in good connecting condition. In this case, it is preferred that the projecting heights of the connecting electrodes 13*a* and 13*b* and the dummy electrodes 14 from the surface of the substrate 11 are set to be equal to each other. As long as such condition is satisfied, other projecting portions may be employed in place of the dummy electrodes 14.

Figure 16:
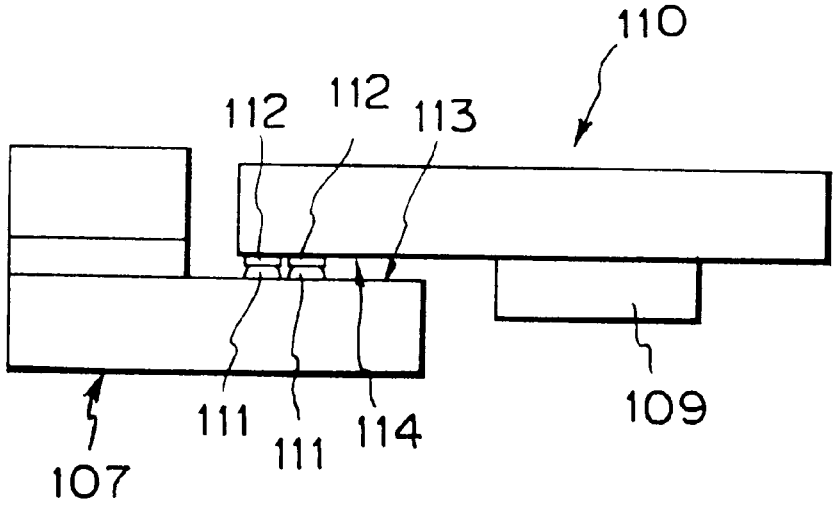
FIG. 16 (PRIOR ART)
FIG. 16 is a conceptual illustration showing a coupled condition of the conventional energy generation element unit and the driving element unit.
Figure 17:
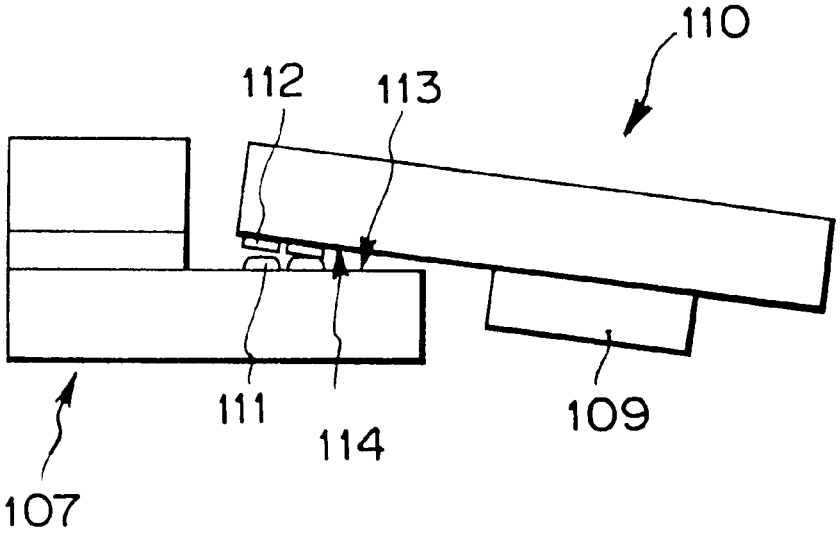
FIG. 17 (PRIOR ART)
FIG. 17 is a conceptual illustration showing a condition of occurrence of connection failure of connection electrodes in FIG. 16.

By thus forming the dummy electrodes 14 and 21, allowable range of position error of the acting point of the connecting force upon mating the energy generation element unit $U_E$ and the driving element unit $U_D$ can be expanded in comparison with that in the prior art shown in FIGS. 16 and 17. Thus, positioning mechanism for the energy generation element unit $U_E$ and the driving element unit $U_D$ can be simplified to achieve lowering of cost.

Figure 7:
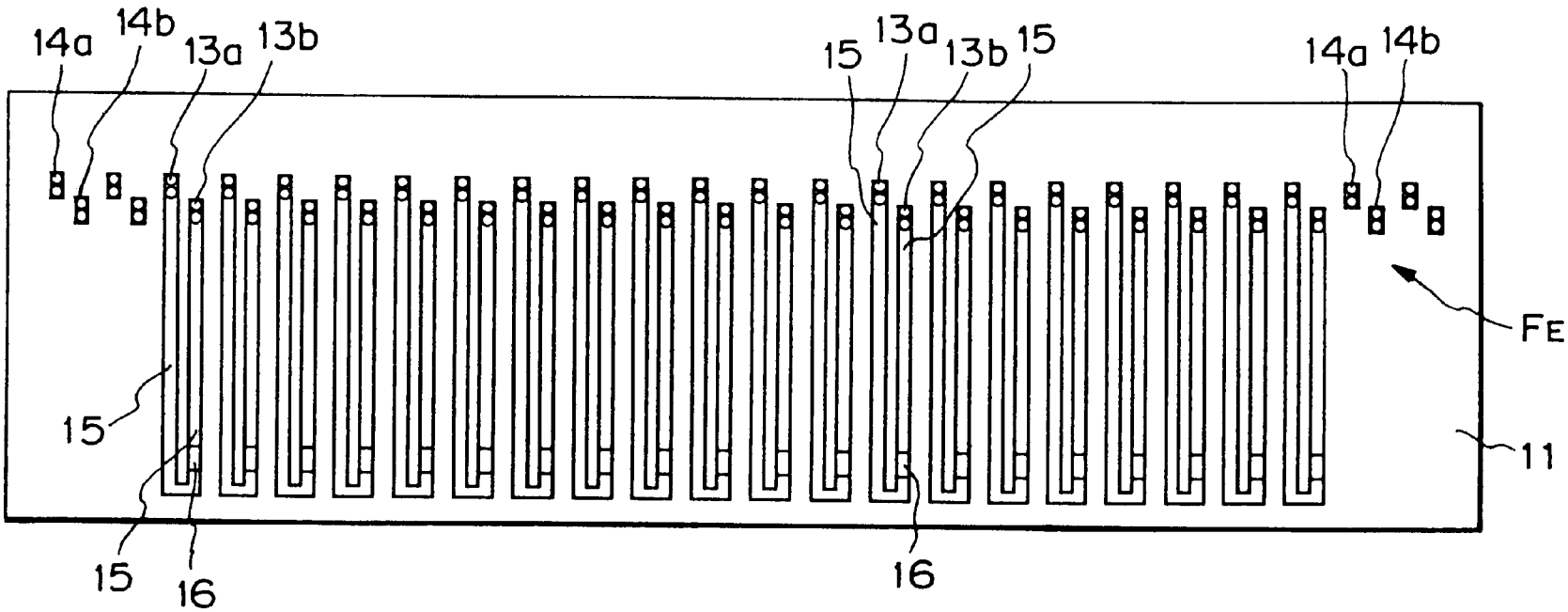
FIG. 7 is a plan view showing a configuration of the second embodiment of a portion of a substrate forming an energy generation element unit of an ink-jet head according to the present invention.

While the dummy electrodes 14 are formed along the alignment direction of the connecting electrodes 13*a* and 13*b* inclined to one end side in the back and forth direction of the substrate than the connection electrodes 13*a* and 13*b* in the foregoing embodiment, it is possible to arrange dummy electrodes 14*a* and 14*b* at both longitudinal ends of the substrate 11, namely at both ends along the aligning direction of the connecting electrodes 13*a* and 13*b* in alignment with the latter, as shown in FIG. 7, in which the external appearance of the surface of the substrate in the second embodiment of the present invention is illustrated. Also, as shown in FIG. 8, in which the external appearance of the surface of the substrate in the third embodiment of the present invention is illustrated, it is possible to form the dummy electrode along the alignment direction of the connecting electrodes 13*a* and 13*b* inclined to one end side in the back and forth direction of the substrate than the connection electrodes 13*a* and 13*b*, and form the dummy electrodes 14*a* and 14*b* at both longitudinal ends in alignment with the connecting electrodes 13*a* and 13*b*, by combining the foregoing two embodiments.

Figure 8:
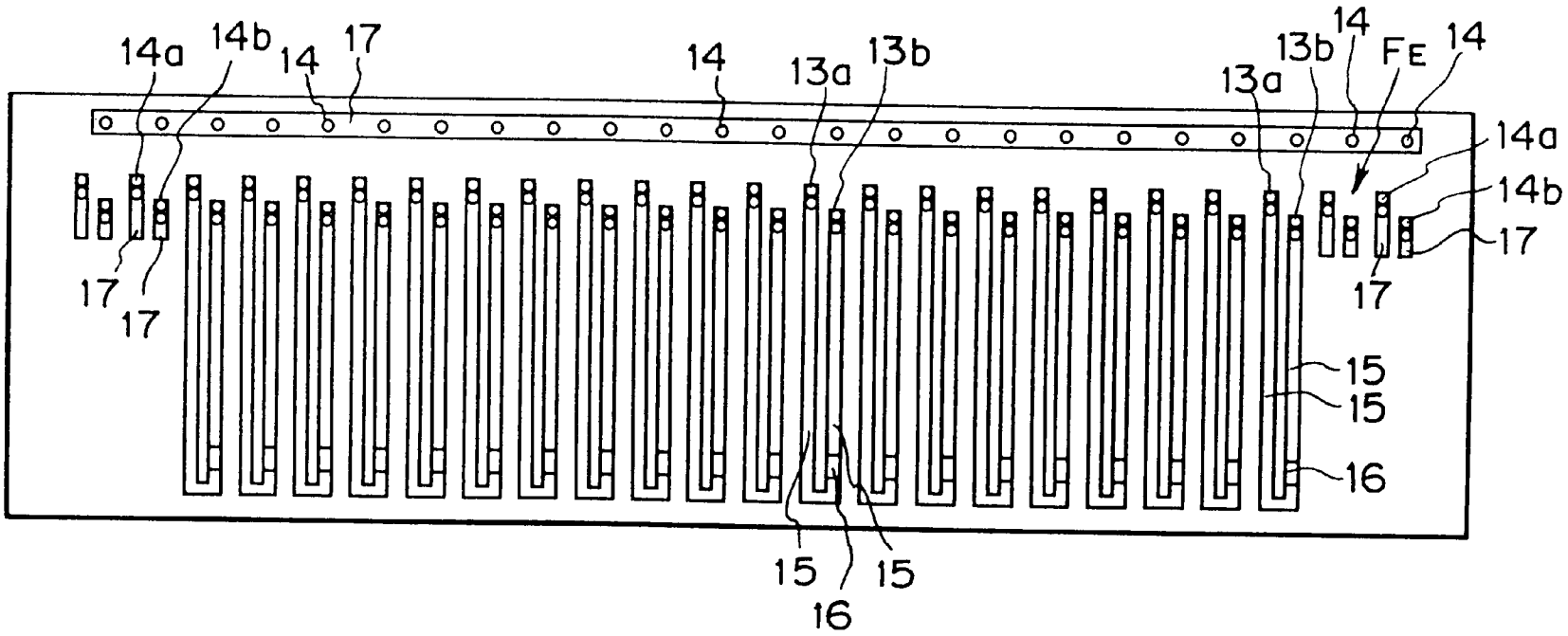
FIG. 8 is a plan view showing a configuration of the third embodiment of a substrate forming an energy generation element unit of an ink-jet head according to the present invention.

It should be noted that in FIGS. 7 and 8, the elements performing the same function to those in the former embodiment shown in FIG. 1 are represented by the same reference numerals.

Figure 9:
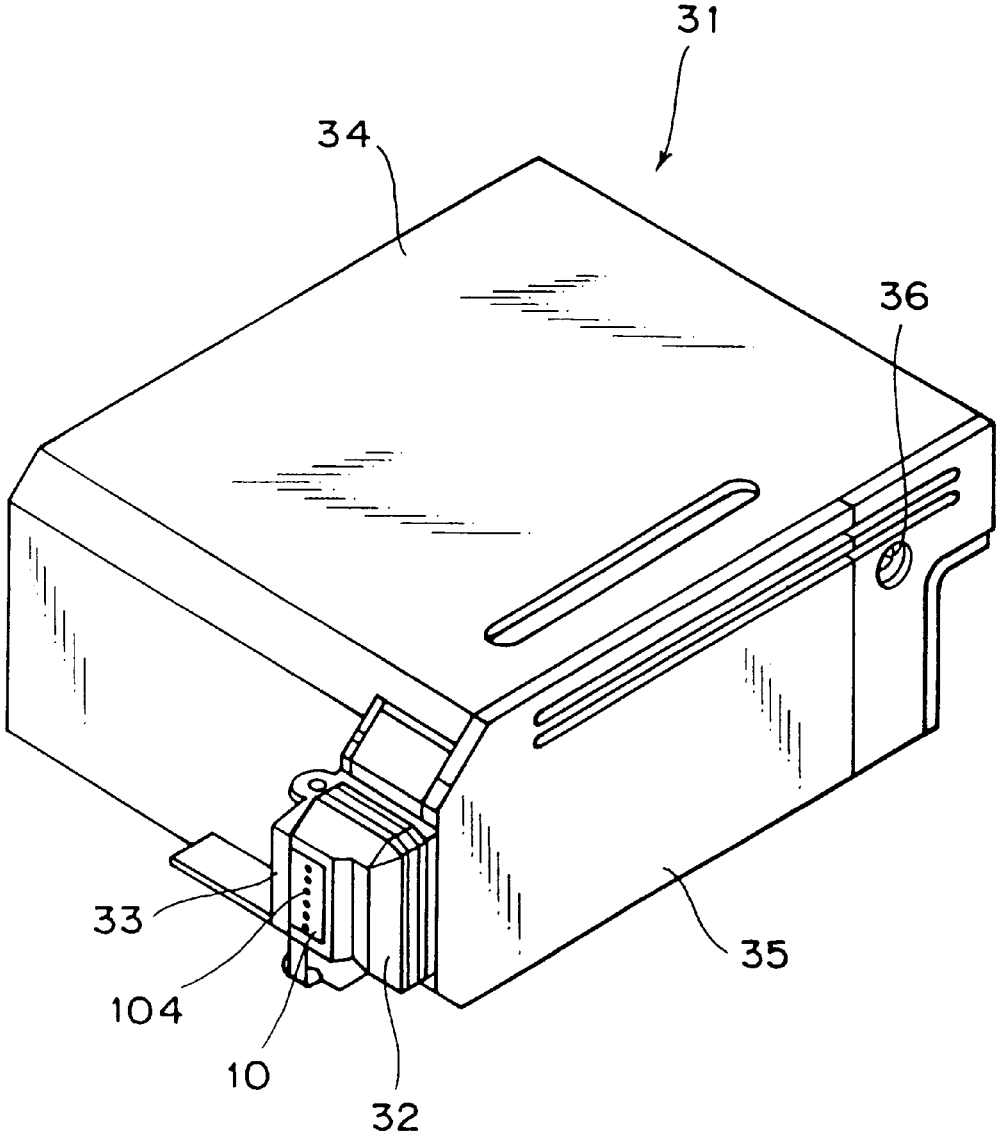
FIG. 9 is a perspective view showing external appearance of the first embodiment of an ink-jet cartridge according to the present invention.

Next, one embodiment of an ink-jet cartridge according to the present invention, in which the foregoing ink-jet head is loaded will be discussed with reference to FIG. 9 illustrating the external appearance.

Namely, the shown embodiment of an ink-jet cartridge 31 is positioned on a carriage of a not shown serial type ink-jet apparatus transmitting and receiving electrical signal with the ink-jet apparatus. The ink-jet cartridge 31 which is detachably mounted on the carriage is mainly constructed with the ink-jet head 10, a head holder 32 for holding the ink-jet head 10, a pushing block 33 for pushing ink-jet head 10 toward the head holder 32, an ink tank 34 storing an ink and a lid member 35 for sealingly closing the ink tank 34. In the ink tank 34 which occupies most part of volume of the ink-jet cartridge 31, an atmosphere communication aperture 36 for maintaining internal pressure of the ink tank 34 at the atmospheric pressure.

The ink-jet head formed with a large number of ejection openings for ejecting ink, has a construction corresponding to the previously discussed embodiment of FIGS. 1 to 8. The ink-jet head 10 is pushed to the head holder 32 by the pushing block 33 and thus held therein. The ink is introduced from the ink tank 34 to the common ink chamber 105 and respective ink passages 103 via not shown ink supply tubes and communication passages of the ink-jet head 10 (see FIG. 12, respectively).

The shown embodiment of the ink-jet cartridge 31 is integrally formed with the ink-jet head 10 and the ink tank 34. However, the ink-jet cartridge 31 may have a construction, in which the ink-tank 34 is exchangeably coupled with the ink-jet head 10.

Figure 10:
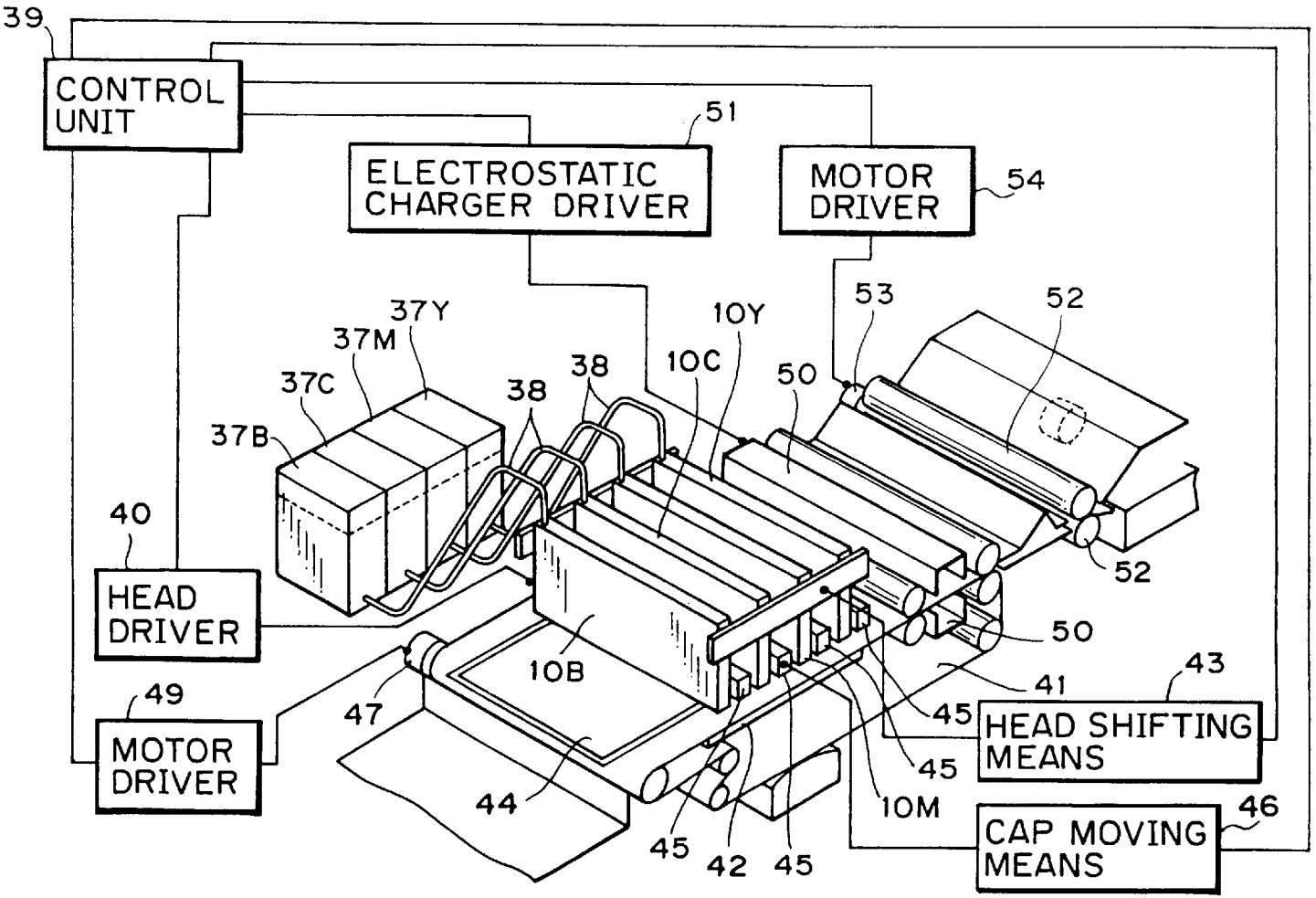
FIG. 10 is a conceptual illustration showing an external appearance of the first embodiment of the ink-jet apparatus according to the present invention.

Also, an external appearance of one embodiment of an ink-jet apparatus according to the present invention loaded the ink-jet head according to the invention is shown in FIG. 10. The shown embodiment of the ink-jet apparatus is a full-line type color printer which has four ink tanks 37Y, 37M, 37C and 37B (hereinafter generally referred to as ink tanks 37) respectively storing yellow color ink, magenta color ink, cyan color ink and black color ink, and four ink-jet heads 10Y, 10M, 10C and 10B (hereinafter generally referred to as ink-jet heads 10) having ink supply tubes connected to the ink tanks 37 via connection piping 38. Respective ink tanks 37 are exchangeably connected with the connection piping 38.

The ink-jet head 10 which is switched power supply for respective head generating resistors 16 between ON and OFF by a head driver 40 which is connected to a control unit 39, has the basically the identical construction to that in the embodiment shown in FIGS. 1 to 8. The ink-jet heads 10 are arranged in opposition to a platen 42 across an endless transporting belt 41 with a given interval along a transporting direction of the transporting belt 41. By means of a head shifting means 43 for recovery process, operation of which is controlled by the control unit 39, the ink-jet heads 10 can be shifted fore and aft with respect to the platen 42 in the opposing direction. At the side of each ink-jet head 10, a head cap 45 for performing recovery process of the ink-jet head 10 by ejecting the old ink in the ink passage 103 through ink ejection openings 104, is arranged with an offset for a half pitch relative to arrangement interval of the ink-jet heads 10. By cap moving means 46, operation of which is controlled by the control unit 39, the head caps 45 are shifted immediately below the corresponding ink-jet head 10 to receive the waste ink ejected from the ink ejection openings 104.

The transporting belt 41 for transporting a printing paper 44 is wound around a driving roller which is, in turn, connected to a belt driving motor 47. Operation of the belt driving motor 47 is switched by a motor driver 49 connected to the control unit 39. On the other hand, at upstream side of the transporting belt 41, an electrostatic charger 50 for tightly fitting the printing paper 44 onto the transporting belt 41 by charging the transporting belt, is provided. Power supply for the electrostatic charger 50 is switched between ON and OFF by a electrostatic charger driver 51 connected to the control unit 39. To a pair of feeder rollers 52 for feeding the printing paper 44 onto the transporting belt 41, a feeder motor 53 is connected for rotatingly driving the pair of feeder rollers 52. Operation of the feeder motor 53 is switched by a motor driver 54 connected to the control unit 39.

Accordingly, in advance of printing operation for the printing paper 44, the ink-jet head 10 is lifted away from the platen 42. Then, the head cap 45 is moved immediately below the ink-jet head 10 to perform recovery process. Thereafter, the head cap 45 is moved to the initial position, and the ink-jet head 10 is shifted toward the platen 42 to be placed at a printing position. Then, the electrostatic charger 50 is actuated, and, in conjunction therewith the transporting belt 41 is driven to mount the printing paper on the transporting belt 41 by the feeder rollers 52. Thereafter, predetermined color image is printed on the printing paper by respective ink-jet head.

It should be noted that while the foregoing embodiments has been discussed in terms of the ink-jet head employing the electrothermal transducer element for generating the heat energy as the energy generation element for achieving high printing density and high precision, the invention should be applicable for the ink-jet head employing an electromechanical transducer, such as piezoelectric element or so forth.

A typical structure and operational principle of the ink-jet head using above electothermal transducers on laser light is disclosed in U.S. Pat. Nos. 4,723,129 and 4,740,796, and it is preferable to use this basic principle to implement such a system. Although this system can be applied either to on-demand type or continuous type ink jet recording systems, it is particularly suitable for the on-demand type apparatus. This is because the on-demand type apparatus has electrothermal transducers, each disposed on a sheet or liquid passage that retains liquid (ink), and operates as follows: first, one or more drive signals are applied to the electrothermal transducers to cause thermal energy corresponding to recording information; second, the thermal energy induces sudden temperature rise that exceeds the nucleate boiling so as to cause the film boiling on heating portions of the recording head; and third, bubbles are grown in the liquid (ink) corresponding to the drive signals. By using the growth and collapse of the bubbles, the ink is expelled from at least one of the ink ejection orifices of the head to form one or more ink drops. The drive signal in the form of a pulse is preferable because the growth and collapse of the bubbles can be achieved instantaneously and suitably by this form of drive signal. As a drive signal in the form of a pulse, those described in U.S. Pat. Nos. 4,163,359 and 4,345,262 are preferable. In addition, it is preferable that the rate of temperature rise of the heating portions described in U.S. Pat. No. 4,313,124 be adopted to achieve better recording.

U.S. Pat. Nos. 4,558,333 and 4,459,600 disclose the following structure of a recording head, which is incorporated to the present invention: this structure includes heating portions disposed on bent portions in addition to a combination of the ejection orifices, liquid passages and the electrothermal transducers disclosed in the above patents. Moreover, the present invention can be applied to structures disclosed in Japanese Patent: Application Laid-open Nos. 123670/1984 and 138461/1984 in order to achieve similar effects. The former discloses a structure in which a slit common to all the electrothermal transducers is used as ejection orifices of the electrothermal transducers, and the latter discloses a structure in which openings for absorbing pressure waves caused by thermal energy are formed corresponding to the ejection orifices. Thus, irrespective of the type of the recording head, the present invention can achieve recording positively and effectively.

The present invention can be also applied to a so-called full-line type recording head whose length equals the maximum length across a recording medium. Such a recording head may consists of a plurality of recording heads combined together, or one integrally arranged recording head.

In addition, the present invention can be applied to various serial type recording heads: a recording head fixed to the main assembly of a recording apparatus; a conveniently replaceable chip type recording head which, when loaded on the main assembly of a recording apparatus, is electrically connected to the main assembly, and is supplied with ink therefrom; and a cartridge type recording head integrally including an ink reservoir.

It is further preferable to add a recovery system, or a preliminary auxiliary system for a recording head as a constituent of the recording apparatus because they serve to make the effect of the present invention more reliable. As examples of the recovery system, are a capping means and a cleaning means for the recording head, and a pressure or suction means for the recording head. As examples of the preliminary auxiliary system, are a preliminary heating means utilizing electrothermal transducers or a combination of other heater elements and the electrothermal transducers, and a means for carrying out preliminary ejection of ink independently of the ejection for recording. These systems are effective for reliable recording.

The number and type of recording heads to be mounted on a recording apparatus can be also changed. For example, only one recording head corresponding to a single color ink, or a plurality of recording heads corresponding to a plurality of inks different in color or concentration can be used. In other words, the present invention can be effectively applied to an apparatus having at least one of the monochromatic, multi-color and full-color modes. Here, the monochromatic mode performs recording by using only one major color such as black. The multi-color mode carries out recording by using different color inks, and the full-color mode performs recording by color mixing.

Furthermore, although the above-described embodiments use liquid ink, inks that are liquid when the recording signal is applied can be used: for example, inks can be employed that solidify at a temperature lower than the room temperature and are softened or liquefied in the room temperature. This is because in the ink jet system, the ink is generally temperature adjusted in a range of 30° C.–70° C. so that the viscosity of the ink is maintained at such a value that the ink can be ejected reliably.

In addition, the present invention can be applied to such apparatus where the ink is liquefied just before the ejection by the thermal energy as follows so that the ink is expelled from the orifices in the liquid state, and then begins to solidify on hitting the recording medium, thereby preventing the ink evaporation: the ink is transformed from solid to liquid state by positively utilizing the thermal energy which would otherwise cause the temperature rise; or the ink, which is dry when left in air, is liquefied in response to the thermal energy of the recording signal. In such cases, the ink may be retained in recesses or through holes formed in a porous sheet as liquid or solid substances so that the ink faces the electrothermal transducers as described in Japanese Patent Application Laid-open Nos. 56847/1979 or 71260/1985. The present invention is most effective when it uses the film boiling phenomenon to expel the ink.

Furthermore, the ink jet recording apparatus of the present invention can be employed not only as an image output terminal of an information processing device such as a computer, but also as an output device of a copying machine including a reader, and as an output device of a facsimile apparatus having a transmission and receiving function.

The present invention has been described in detail with respect to various embodiments, and it will now be apparent from the foregoing to those skilled in the art that changes and modifications may be made without departing from the invention in its broader aspects, and it is the intention, therefore, in the appended claims to cover all such changes and modifications as fall within the true spirit of the invention.

What is claimed is:

1. An ink jet head comprising:

an energy generation element unit having a mating surface, a plurality of energy generation elements for ejecting a liquid, a plurality of connecting electrodes projectingly formed on said mating surface, and a plurality of signal wires each having a first end and a second end, said first end and said second end being connected to said energy generation elements and said connecting electrodes, respectively;

a driving element unit having a mating surface, a plurality of driving elements for driving said energy generation elements, a plurality of connecting electrodes projectingly formed on said mating surface, and a plurality of signal wires each having a first end and a second end, said first end and said second end being connected to said driving elements and said connecting electrodes, respectively, said connecting electrodes of said energy generation element unit and said connecting electrodes of said driving element unit being connected to each other by mutually mating together said mating surfaces; and a projecting portion for maintaining a gap between said mating surfaces of said energy generation element unit and said driving element unit, wherein a part of said projecting portion is aligned with respective said connecting electrodes.

2. An ink jet head comprising:

an energy generation element unit having a mating surface, a plurality of energy generation elements for ejecting a liquid, a plurality of connecting electrodes projectingly formed on said mating surface, and a plurality of signal wires each having a first end and a second end, said first end and said second end being connected to said energy generation elements and said connecting electrodes, respectively;

a driving element unit having a mating surface, a plurality of driving elements for driving said energy generation elements, a plurality of connecting electrodes projectingly formed on said mating surface, and a plurality of signal wires each having a first end and a second end, said first end and said second end being connected to said driving elements and said connecting electrodes, respectively, said connecting electrodes of said energy generation element unit and said connecting electrodes of said driving element unit being connected to each other by mutually mating said mating surfaces; and a projecting portion for maintaining a gap between said mating surfaces of said energy generation element unit and said driving element unit, wherein a part of said projecting portion is aligned on a line extending from at least one of said signal wires of said energy generation element unit and said signal wires of said driving element unit along a direction of arrangement of respective said connecting electrodes.

3. An ink-jet head as claimed in claim 1, wherein a first part of said projecting portion is aligned with said connecting electrodes of said energy generation element unit and said connecting elements of said driving element unit and a second part of said projecting portion is aligned on a line extending from one of said first ends and said second ends of said signal wires of said energy generation element unit and said first ends and said second ends of said signal wires of said driving element unit along the direction of arrangement of respective said connecting electrodes.

4. An ink-jet head as claimed in claim 1, wherein said projecting portion is a dummy electrode in a shape corresponding to said connecting electrode.

5. An ink-jet head as claimed in claim 1, wherein said energy generation element is an electrothermal transducer causing thermal energy for causing the film boiling in the liquid.

6. An ink-jet cartridge comprising:

an ink-jet head including an energy generation element unit having a mating surface, a plurality of energy generation elements for ejecting a liquid, a plurality of connecting electrodes projectingly formed on said mating surface, and a plurality of signal wires each having a first end and a second end, said first end and said second end being connected to said energy generation elements and said connecting electrodes, respectively, a driving element unit having a mating surface, a plurality of driving elements for driving said energy generation elements, a plurality of connecting electrodes projectingly formed on said mating surface, and a plurality of signal wires each having a first end and a second end, said first end and said second end being connected to said driving elements and said connecting electrodes, respectively, said connecting electrodes of said energy generation element unit and said connecting electrodes of said driving element unit being connected to each other by mutually mating said mating surfaces, a projecting portion for maintaining a gap between said mating surfaces formed on at least one of said energy generation element unit and said driving element unit; and a liquid tank which stores said liquid for supply to said ink-jet head, wherein a part of said projecting portion is aligned with respective said connecting electrodes.

7. An ink-jet cartridge as claimed in claim 6, wherein said liquid is at least one of an ink and a treatment liquid for adjusting a property of the ink to be ejected onto a printing medium.

8. An ink-jet apparatus, comprising:

an ink-jet head, said ink-jet head including;

an energy generation element unit having a mating surface, a plurality of energy generation elements for ejecting a liquid, a plurality of connecting electrodes projectingly formed on said mating surface, and a plurality of signal wires each having a first end and a second end, said first end and said second end being connected to said energy generation elements and said connecting electrodes, respectively;

a driving element unit having a mating surface, a plurality of driving elements for driving said energy generation elements, a plurality of connecting electrodes projectingly formed on said mating surface, and a plurality of signal wires each having a first end and a second end, said first end and said second end being connected to said driving elements and said connecting electrodes, respectively, said connecting electrodes of said energy generation element unit and said connecting electrodes driving element unit being connected to each other by mutually mating said mating surfaces; and a projecting portion for maintaining a gap between said mating surfaces of said energy generation element unit and said driving element unit, wherein a part of said projecting portion is aligned with respective said connecting electrodes.

9. An ink-jet apparatus, comprising:

an ink-jet head, said ink-jet head including;

an energy generation element unit having a mating surface, a plurality of energy generation elements for ejecting a liquid, a plurality of connecting electrodes projectingly formed on said mating surface, and a plurality of signal wires each having a first end and a second end, said first end and said second end being connected to said energy generation elements and said connecting electrodes, respectively;

a driving element unit having a mating surface, a plurality of driving elements for driving said energy generation elements, a plurality of connecting electrodes projectingly formed on said mating surface, and a plurality of signal wires each having a first end and a second end, said first end and said second end being connected to said driving elements and said connecting electrodes, respectively, said connecting electrodes of said energy generating element unit and said connecting electrodes of said driving element unit being connected to each other by mutually mating together said mating surfaces; and a projecting portion for maintaining a gap between said mating surfaces of said energy generation element unit and said driving element unit, wherein a part of said projecting portion is aligned on a line extending from at least one of said signal wires of said energy generating element unit and said signal wires of said driving element unit along a direction of arrangement of respective said connecting electrodes.

10. An ink-jet apparatus as claimed in claim 8, wherein a first part of said projecting portion is aligned with said connecting electrodes of said energy generation element unit and said connecting elements of said driving element unit and a second part of said projecting portion is aligned on a line extending from one of said first ends and said second ends of said signal wires of said energy generation element unit and said first ends and said second ends of said signal wires of said driving element unit along the direction of arrangement of respective said connecting electrodes.

11. An ink-jet apparatus as claimed in claim 8, wherein said projecting portion is a dummy electrode in a shape corresponding to said connecting electrode.

12. An ink-jet apparatus as claimed in claim 8, wherein a plurality of ejection openings are arranged over an entire width of a printing region of a printing medium.

13. An ink-jet head as in claim 2, wherein a first part of said projecting portion is aligned with respective said connecting electrodes and a second part of said projecting portion is aligned on an extension of one of said ends of respective said signal wires along the arranging direction of respective said connecting electrodes.

14. An ink-jet head as in claim 2, wherein said projecting portion is a dummy electrode having a shape corresponding to respective said connecting electrodes.

15. An ink-jet head as in claim 2, wherein said energy generation element is an electrothermal transducer producing thermal energy to cause film boiling in the liquid.

16. An ink-jet cartridge comprising:

an ink-jet head including an energy generation element unit having a mating surface, a plurality of energy generation elements for ejecting a liquid, a plurality of connecting electrodes projectingly formed on said mating surface, and a plurality of signal wires each having a first end and a second end, said first and said second ends being connected to said energy generation elements and said connecting electrodes, respectively, a driving element unit having a mating surface, a plurality of driving elements for driving said energy generation elements, a plurality of connecting electrodes projectingly formed on said mating surface, and a plurality of signal wires each having a first end and a second end, said first end and said second end being connected to said driving elements and said connecting electrodes, respectively, said connecting electrodes of said energy generation element unit and said connecting electrodes of said driving element unit being connected to each other by mutually mating together said mating surfaces, a projecting portion for maintaining a gap between said mating surfaces of said energy generation element unit and said driving element unit; and a liquid tank which stores said liquid for supply to said ink-jet head, wherein a part of said projecting portion is aligned on a line extending from at least one of said signal wires of said energy generation element unit and said signal wires of said driving element unit along a direction of arrangement of respective said connecting electrodes.

17. An ink-jet cartridge as in claim 16, wherein said liquid is at least one of an ink and a treatment liquid for adjusting a property of the ink to be ejected onto a printing medium.

18. An ink-jet apparatus as in claim 9, wherein a first part of said projecting portion is aligned with said connecting electrodes of said energy generation element unit and said connecting elements of said driving element unit and a second part of said projecting portion is aligned on a line extending from one of said first ends and said second ends of said signal wires of said energy generation element unit and said first ends and said second ends of said signal wires of said driving element unit along the arranging direction of respective said connecting electrodes.

19. An ink-jet apparatus as in claim 9, wherein said projecting portion is a dummy electrode having a shape corresponding to respective said connecting electrodes.

20. An ink-jet apparatus as in claim 9, wherein a plurality of ejection openings are arranged over an entire width of a printing region of a printing medium.

21. An ink jet head comprising:

an energy generation element unit having a mating surface, a plurality of energy generation elements for ejecting a liquid, a plurality of connecting electrodes projectingly formed on said mating surface, and a plurality of signal wires each having a first end and a second end, said first end and said second end being connected to said energy generation elements and said connecting electrodes, respectively;

a driving element unit having a mating surface, a plurality of driving elements for driving said energy generation elements, a plurality of connecting electrodes projectingly formed on said mating surface, and a plurality of signal wires each having a first end and a second end, said first end and said second end being connected to said driving elements and said connecting electrodes, respectively, said connecting electrodes of said energy generation element unit and said connecting electrodes of said driving element unit being connected to each other by mutually mating together said mating surfaces; and a projecting portion for maintaining a gap between said mating surfaces of said energy generation element unit and said driving element unit, wherein a part of said projecting portion is arranged on a line separated from at least one of said signal wires of said energy generation element unit and said signal wires of said driving element unit along a direction of arrangement of respective said connecting electrodes.

22. An ink-jet apparatus, comprising: an ink-jet head, said ink-jet head including;

an energy generation element unit having a mating surface, a plurality of energy generation elements for ejecting a liquid, a plurality of connecting electrodes projectingly formed on said mating surface, and a plurality of signal wires each having a first end and a second end, said first end and said second end being connected to said energy generation elements and said connecting electrodes, respectively;

a driving element unit having a mating surface, a plurality of driving elements for driving said energy generation elements, a plurality of connecting electrodes projectingly formed on said mating surface, and a plurality of signal wires each having a first end and a second end, said first end and said second end being connected to said driving elements and said connecting electrodes, respectively, said connecting electrodes of said energy generation element unit and said connecting electrodes of said driving element unit being connected to each other by mutually mating together said mating surfaces; and a projecting portion for maintaining a gap between said mating surfaces of said energy generation element unit and said driving element unit, wherein a part of said projecting portion is arranged on a line separated from at least one of said signal wires of said energy generation element unit and said signal wires of said driving element unit along a direction of arrangement of respective said connecting electrodes.

23. An ink-jet cartridge comprising:

an ink-jet head including an energy generation element unit having a mating surface, a plurality of energy generation elements for ejecting a liquid, a plurality of connecting electrodes projectingly formed on said mating surface, and a plurality of signal wires each having a first end and a second end, said first and said second ends being connected to said energy generation elements and said connecting electrodes, respectively, a driving element unit having a mating surface, a plurality of driving elements for driving said energy generation elements, a plurality of connecting electrodes projectingly formed on said mating surface, and a plurality of signal wires each having a first end and a second end, said first end and said second end being connected to said driving elements and said connecting electrodes, respectively, said connecting electrodes of said energy generation element unit and said connecting electrodes of said driving element unit being connected to each other by mutually mating together said mating surfaces, a projecting portion for maintaining a gap between said mating surfaces of said energy generation element unit and said driving element unit; and a liquid tank which stores said liquid for supply to said ink-jet head, wherein a part of said projecting portion is arranged on a line separated from at least one of said signal wires of said energy generation element unit and said signal wires of said driving element unit along a direction of arrangement of respective said connecting electrodes.

* * * * *

UNITED STATES PATENT AND TRADEMARK OFFICE

CERTIFICATE OF CORRECTION

PATENT NO. : 6,024,439
DATED : February 15, 1996
INVENTOR(S) : Sueoka Manabu et al.

It is certified that error appears in the above-identified patent and that said Letters Patent is hereby corrected as shown below:

Title page, item [56],
Attorney, Agent, or Firm, "Fitzpatrick, Cella, Cella & Harper" should read -- Fitzpatrick, Cella, Harper & Scinto --.

Column 1,
Line 11, Q: "loaded" should read -- loaded on --;
Line 21, "Amongst," should read -- Amongst -- ; and
Line 22, "type," should read -- type --.

Column 2,
Line 22, "connection" should read -- connecting --;
Line 26, Q: "loaded" should read -- loaded on --;
Line 56, "projecting" should read -- a projecting --; and
Line 67, "projecting" should read -- a projecting --.

Column 3,
Line 7, "is" should read -- are --;
Line 42, close up right margin; and
Line 50, "projecting" should read -- a projecting --.

Column 4,
Line 15, "projecting" should read -- a projecting --.

Column 6,
Line 5, "a" should be deleted;
Line 12, "electrode 14" should read -- electrodes 14 --;
Line 27, "respective" should read -- respectively --;
Line 31, "151" should read -- 15' --; and
Line 66, "Of" should read -- of --.

Column 8,
Line 26, Q: "head" should read -- heat --;
Line 28, "the basically" should read -- basically --; and
Line 55, "a" should read -- an --.

Column 9,
Line 7, "embodiments" should read -- embodiment --
Line 16, "electothermal" should read -- electrothermal --;
Line 38, "U.S. Pat. Nos. 4,163,359" should read -- U.S. Pat. Nos. 4,463,359 --;
Line 50, "Patent:" should read -- Patent --; and
Line 64, "consists" should read -- consist --.

UNITED STATES PATENT AND TRADEMARK OFFICE

CERTIFICATE OF CORRECTION

PATENT NO. : 6,024,439
DATED : February 15, 1996
INVENTOR(S) : Sueoka Manabu et al.

It is certified that error appears in the above-identified patent and that said Letters Patent is hereby corrected as shown below:

Column 12,
Line 8, Q: "causing thermal" should read -- producing thermal --;
Line 44, "including;" should read -- including: --; and
Line 62, Q: "driving" should read -- of said driving --.

Column 13,
Line 4, "including"; should read -- including: --.

Column 15,
Line 8, "comprising: an" should read -- comprising: ® an --; and
Line 9, "including;" should read -- including: --.

Signed and Sealed this

Sixth Day of November, 2001

*Attest:*

Nicholas P. Godici

*Attesting Officer*

NICHOLAS P. GODICI
*Acting Director of the United States Patent and Trademark Office*